US006776822B2

(12) United States Patent
Johnson

(10) Patent No.: US 6,776,822 B2
(45) Date of Patent: Aug. 17, 2004

(54) AIR FILTRATION DEVICE FOR REDUCING AIRBORNE PARTICULATE MATTER IN ENCLOSURES

(76) Inventor: Dayne Christopher Johnson, 1112 Capital Ave. Apt. 3, San Francisco, CA (US) 94112

( * ) Notice: Subject to any disclaimer, the term of this patent is extended or adjusted under 35 U.S.C. 154(b) by 0 days.

(21) Appl. No.: 10/339,899

(22) Filed: Jan. 10, 2003

(65) Prior Publication Data

US 2004/0134354 A1 Jul. 15, 2004

(51) Int. Cl.[7] ..... B03C 3/016

(52) U.S. Cl. ..... 96/16; 55/385.2; 55/DIG. 29; 96/60; 96/77; 454/189; 454/193

(58) Field of Search ..... 96/16, 96, 97, 96/77, 60, 224; 95/78; 55/385.2, DIG. 29, DIG. 18; 454/188, 189, 193; 422/24, 121

(56) References Cited

U.S. PATENT DOCUMENTS

| | | | | | |
|---|---|---|---|---|---|
| 2,709,954 | A | * | 6/1955 | Baker | 454/60 |
| 2,928,942 | A | * | 3/1960 | Hicks et al. | 361/231 |
| 3,301,167 | A | * | 1/1967 | Howard et al. | 454/60 |
| 3,397,631 | A | * | 8/1968 | Simons | 454/190 |
| 3,511,162 | A | * | 5/1970 | Truhan | 454/187 |
| 3,711,743 | A | * | 1/1973 | Bolasny | 361/231 |
| 3,935,803 | A | * | 2/1976 | Bush | 454/189 |
| 4,202,676 | A | * | 5/1980 | Pelosi, Jr. et al. | 96/416 |
| 4,659,349 | A | * | 4/1987 | Rodi et al. | 55/385.4 |
| 4,927,438 | A | * | 5/1990 | Mears et al. | 55/385.2 |
| 5,181,883 | A | * | 1/1993 | Hofstra et al. | 454/49 |
| 5,865,880 | A | * | 2/1999 | Matsui | 96/26 |
| 6,312,507 | B1 | | 11/2001 | Taylor et al. | 96/19 |
| 6,626,971 | B1 | * | 9/2003 | Forbert et al. | 55/385.2 |

* cited by examiner

*Primary Examiner*—Richard L. Chiesa

(57) ABSTRACT

An air filtration system according to the present invention includes an enclosure having a floor section, a top section and an opening. A ventilation subsystem within the enclosure includes an air duct having an air intake and an exhaust vent. First and second electrode arrays are positioned within the air duct so that the first array is located between the air intake and the second array and the second array is located between the exhaust vent and the first array. A voltage regulator is electrically coupled to the first and second electrode arrays to apply a voltage differential between the electrode arrays that creates an air flow within the air duct drawing air into the air intake and out of the exhaust vent. Airborne particulate matter carried through the air duct collects on the second electrode array. The exhaust vent is positioned over the opening to the enclosure so that the exhaust air traverses the opening to create an air curtain barrier that at least partially prevents airborne particulate matter from escaping the interior of the enclosure. Furthermore, air that exits the exhaust vent is eventually recirculated into the air intake to minimize the concentration of airborne particulate matter.

10 Claims, 2 Drawing Sheets

AIR FILTRATION DEVICE FOR REDUCING AIRBORNE PARTICULATE MATTER IN ENCLOSURES

BACKGROUND OF THE INVENTION

1. Field of the Invention

The present invention relates generally to air filtration systems and more specifically to an ionic air filtration apparatus positioned within an enclosure, such as enclosed a pet litter boxe.

2. Description of the Related Art

Ionic air filtration devices are well known in the art. For example, free standing ionic air filtration devices can be used to remove airborne particulate matter in a room. These ionic air filtration devices utilize two electronically charged electrodes having opposite polarities to draw air over the two electrodes. As airborne particulate matter approaches the second electrode (oppositely charged from the first electrode) the particles are trapped by the second electrode. Such a freestanding device that can be advantageously employed to reduce the concentration of airborne particulate matter indoors.

There are certain instances, however, where a particular airborne particulate matter is generated by a particular source. In these instances the prior art freestanding ionic filtration device must be positioned near the source of particulate matter in order to be most effective at reducing the concentration of airborne particulate matter emanating from the source. This solution is imperfect. A large percentage of the particles avoid entrapment by the device and the particles wind up scattered by airflow around the room.

Pet litter boxes are one common source of airborne particles in households. Pet litter boxes include open and enclosed structures. Although a freestanding ionic filtration device can reduce the amount of airborne particles if properly positioned near a closed pet litter box, inevitably a large percentage of the airborne particles are carried on air currents away from the filtration device and are thereby distributed in the air throughout a room. Although enclosed pet litter boxes reduce the distribution of airborne particles compared to open litter boxes, nonetheless a significant amount of unhygienic and foul smelling airborne particles are released from the opening to the enclosure.

U.S. Pat. No. 6,312,507 to Taylor et al ("Taylor") describes an electro-kinetic air refreshener-conditioner that is attached to either a pet shelter or litter box to reduce air borne particulate matter. In Taylor, the device is attached either to the lip of an open-faced litter box or over a vent on the top of an enclosed pet shelter. As shown in FIG. 2B of Taylor, when the device is attached on the top of the enclosed shelter it draws air from within the pet shelter enclosure, through the device where it removes particulate matter from this air, and then extrudes the exhaust out away from the interior of the enclosure.

No air filtration device can remove 100% of the airborne particulate matter from the air that passes through the device. Thus, to the extent that the Taylor device fails to remove airborne particulate matter, the airborne particulate matter from the interior of the enclosure is distributed into the room in which the enclosure is located. Given that the extruded air might contain contagions and other undesirable matter, the Taylor patent leaves room for improvement.

What is needed is an improved system for reducing the amount of airborne particles released from enclosures such as pet litter boxes and animal shelters.

SUMMARY OF THE INVENTION

An air filtration system according to the present invention includes an enclosure having an opening (variously described as an entrance) and having a floor and a top covering the floor. The top can be a dome, a four-sided structure with a flat roof or any of a variety of other geometric designs. The air filtration system also includes an air duct, which is preferably positioned on the underside of the cover within the enclosure. The air duct has an exhaust vent positioned in close proximity to the opening to the enclosure and an air intake at a position within the enclosure that is distant from the opening. Within the air duct are two electrodes. Two electrode arrays can be employed as an alternative to two individual electrodes. A first electrode array is positioned closer to the air intake relative to the second electrode array and the second array is closer to the exhaust vent relative to the first array.

A voltage regulator is electrically coupled to the first and second electrodes (or electrode arrays). The voltage regulator creates a voltage differential between the first and second electrode arrays. As a result of the voltage differential an air flow is generated that moves air from the first electrode array to the second electrode array. As air moves from the first electrode array it carries airborne particulate matter that is attracted to and trapped by the second electrode array. In a preferred embodiment an ultraviolet light source is included in the air duct to irradiate exhaust prior to its exiting the exhaust vent.

The exhaust vent is preferably positioned over the opening to the enclosure so that the exhaust flows down from the top of the opening to the floor. This air flow created by the exhaust acts as an air curtain barrier that at least partially prevents air from the inside of the enclosure from escaping to the outside. The intake continues to draw air into the air duct so that air that was expelled out of the exhaust vent is recirculated into the air duct to be purified by the air filtration system.

In a preferred embodiment the air filtration system is employed in a covered pet litter box. Advantageously, the system substantially prevents particulate matter and odors from escaping the litter box while simultaneously purifying and the air within the litter box.

DETAILED DESCRIPTION OF THE PREFERED EMBODIMENT

Figure 1:
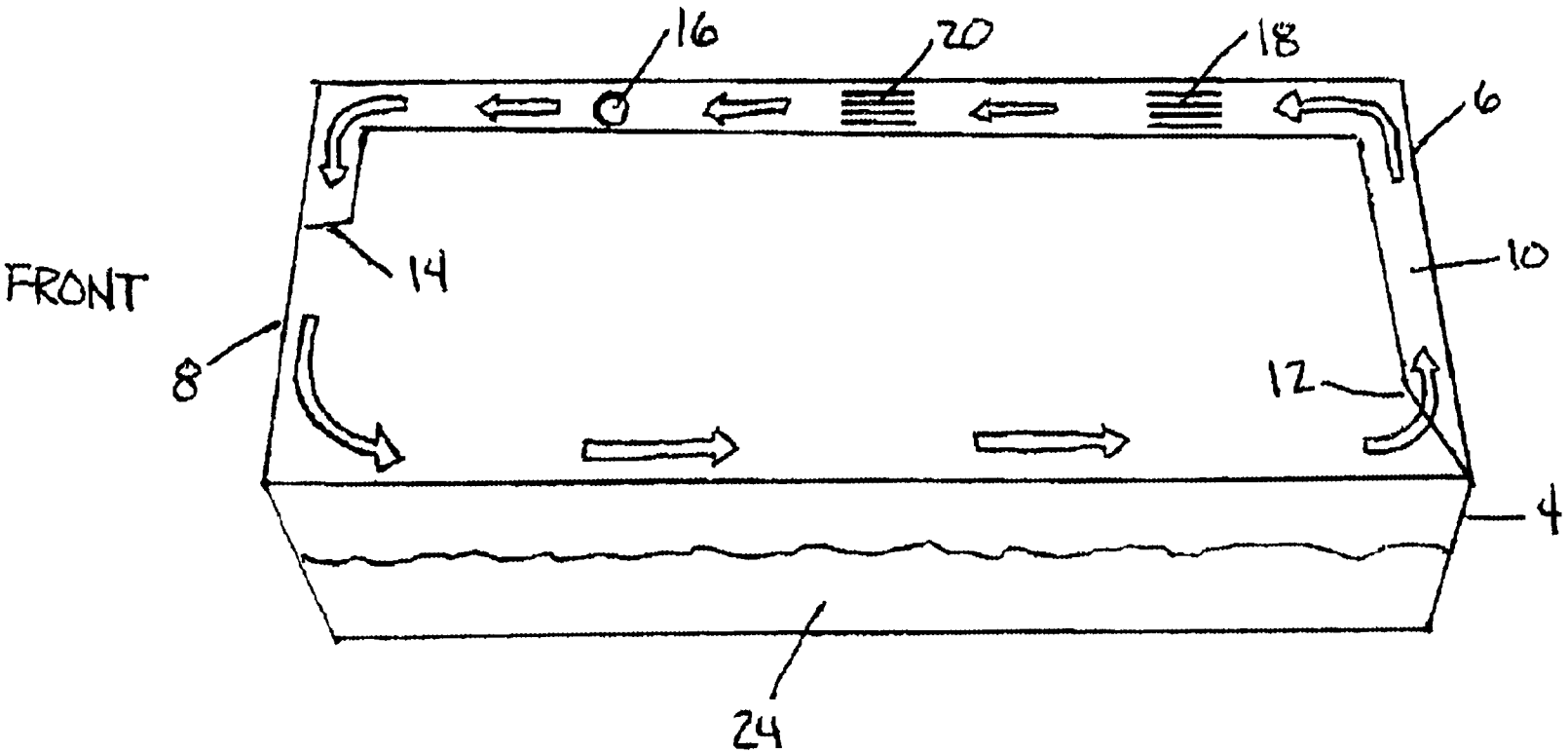
FIG. 1 is a cross sectional side view of an ionic filtration system according to the present invention.
Figure 2:
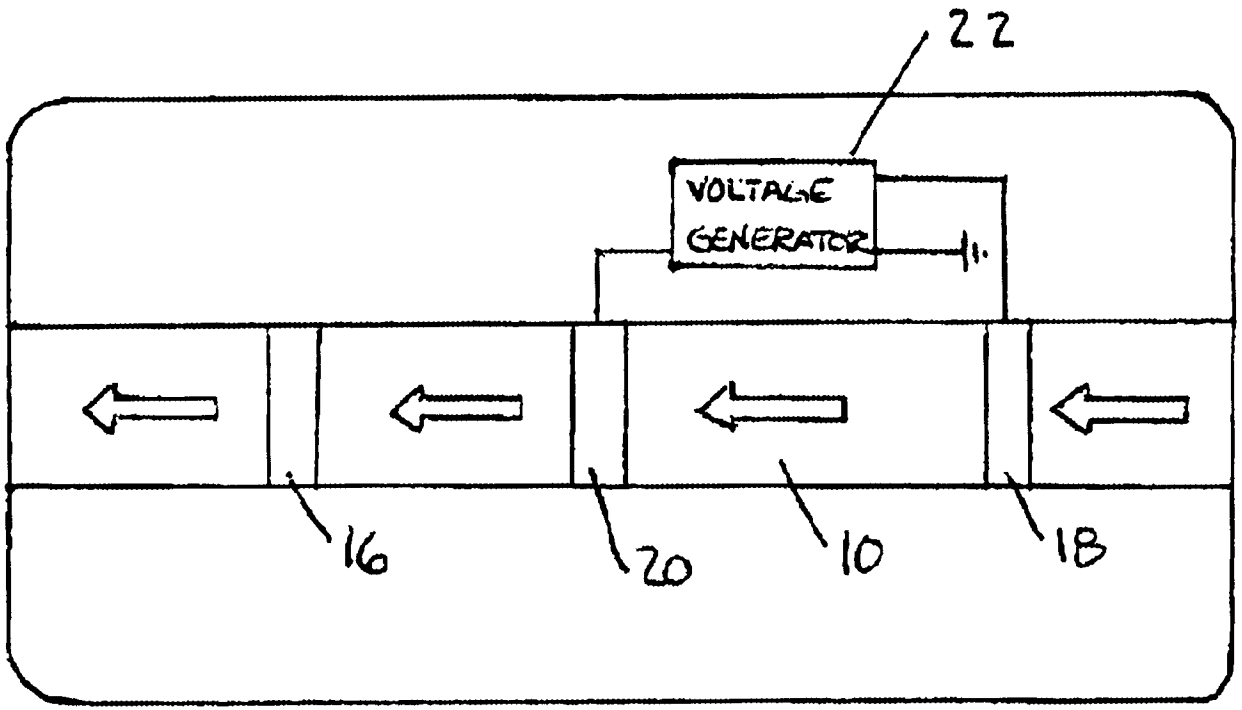
FIG. 2 is an overhead cross sectional view of an ionic filtration system according to the present invention.

With reference to FIGS. 1 and 2, the air filtration system according to the present invention is represented in the embodiment of a pet litter box 2. It should be understood that the present invention is equally adaptable to other enclosures such as pet carriers, for example. The pet litter box 2 is an enclosure (variously described as a container) that includes a floor section 4 and a top section 6 that has an opening 8 through which a pet can enter and exit the enclosure. The floor section 4 and the top section 6 can be formed integrally, for example as a single piece of molded plastic or other suitable material. Alternatively, the floor section 4 and top section 6 can be constructed so that they are removably attached to facilitate cleaning of the inside of the pet litter box 2. The floor section can be constructed to have sufficient depth to hold pet litter 24, generally a granular substance, to hold pet waste.

The top section 6 includes an air duct 10 that has an air intake 12 and an exhaust vent 14. In a preferred embodiment the exhaust vent 14 is positioned over the opening 8 to the pet litter box 2 so that air expelled by the exhaust vent 14 traverses the opening 8 to create an air curtain that serves as a barrier to at least partially prevent air flow from the interior to the exterior of the pet litter box 2. Arrows in FIGS. 1 and 2 roughly depict the trajectory of airflow within the pet litter box 2. Air that has traversed the opening 8 proceeds generally toward the rear of the pet litter box 2. The air intake 12 is positioned in the rear of the pet litter box 2 so the air that was expelled from the exhaust vent 14 and which then traversed the opening 8 of the pet litter box 2 is eventually recycled back into the air duct 10. As will be explained in greater detail below, this recirculation of air keeps airborne particulate matter from exiting from the interior of the pet litter box and also reduces the amount of airborne particulate matter within the pet litter box 2.

Within the air duct 10 are positioned first and second electrode arrays 18 and 20. Although the preferred embodiment provides electrode arrays, a single first electrode and second electrode could be substituted for the first and second electrode arrays. A voltage regulator 22 is connected to the first and second electrode arrays 18 and 20 to generate a voltage differential between the first and second electrode arrays. When a sufficient voltage differential is applied across the first and second arrays 18 and 20, airflow is generated that moves from the first electrode array 18 toward the second electrode array 20. When the electrode arrays are energized, ions are outputted at the first array 18 that are attracted to the second electrode array 20. This movement of ions creates the airflow from the first electrode array 18 to the second electrode array 20. This airflow causes air to be drawn into the air intake 12 and also causes air to be forced out of the exhaust vent 14.

Airborne particulate matter that is drawn into the air intake 12 adheres electrostatically to the second electrode array 20. In this manner air recirculated within the pet litter box 2 is purified of airborne particulate matter. Furthermore, it is known in the art that the voltage differential applied can be optimized so that ozone is generated as air is moved across the first and second electrode arrays 18 and 20. For example, U.S. Pat. No. 6,312,507, which is hereby incorporated by reference, describes such optimization. Safe amounts of ozone can destroy potentially damaging airborne contagions such as bacteria and other organisms. Optimizing the application of voltage differential also can increase or decrease airflow rate and ion content of the exhaust exiting the exhaust vent 14.

An ultraviolet light source 16 is preferably included in the air duct 10. Preferably the ultraviolet light source 16 is positioned between the second electrode array 20 and the exhaust vent 14, although it can also be positioned between the air intake 12 and the first electrode array 18. The ultraviolet light source irradiates the air passing through the air duct 10 before it is discharged from the exhaust vent 14 to sterilize the any airborne particulate matter that was not trapped by the second electrode array 20 before being released back into the pet litter box enclosure.

Modifications and variations may be made to the disclosed embodiments without departing from the subject and spirit of the invention as defined by the following claims.

I claim:

1. An air filtration system comprising:

an enclosure having a floor, a covering over said floor, and at least one opening;

an air duct positioned within said enclosure having an air exhaust vent positioned proximally to said enclosure opening and an air intake positioned distally from said opening;

an ionic air filtration assembly positioned within said air duct and having a first electrode array and a second electrode array; and a voltage regulator electrically coupled to said first electrode array and said second electrode array to create a voltage differential between said first electrode array and said second electrode array that creates an air flow that moves from said first electrode array toward said second electrode array;

wherein particulate matter carried by said air flow is trapped on a surface of said second electrode array;

wherein exhaust exiting out of said exhaust vent passes over said enclosure opening to create an air curtain barrier.

2. The system of claim 1 further comprising an ultraviolet light source positioned in said air duct to irradiate said exhaust prior to its exiting said air exhaust vent.

3. The system of claim 1 wherein said air duct is positioned within said enclosure such that said exhaust passing over said enclosure entrance continues across said floor of said enclosure to said air duct intake where said exhaust is recirculated into said air duct.

4. The system of claim 1 wherein said air curtain barrier at least partially prevents airflow from the interior to the exterior of said enclosure.

5. The system of claim 3 wherein said enclosure is a pet litter box containing a substance for carrying animal waste and further wherein said recirculation of said exhaust across said enclosure floor carries airborne particulate matter associated with one of said animal waste and said substance for carrying said animal waste to be carried toward said air intake of said air duct.

6. An ionic air filtration device comprising:

a container having a floor section, a top substantially covering said floor section, and an opening providing an entrance to said container;

a ventilation subsystem having an air duct with an air exhaust vent positioned proximally to said opening to said container and an air intake positioned distally from said opening and further including:

a) first and second electrodes positioned within said air duct so that said first electrode is located between said air intake and said second electrode and said second electrode is positioned between said air exhaust vent and said first electrode; and b) a voltage regulator electrically coupled to said first and second electrodes to generate a voltage differential between said first and second electrodes that creates an air flow moving from said first electrode to said second electrode such that airborne particulate matter collects on said second electrode;

wherein said air flow generates exhaust expelled out of said exhaust vent to create an air curtain barrier at said entrance to said container.

7. The device of claim 6 wherein said container is a pet litter box.

8. The device of claim 6 further comprising an ultraviolet light source positioned in said air duct to irradiate said exhaust prior to its passing over said entrance to said container.

9. The device of claim 6 wherein said air curtain barrier at least partially prevents airflow from between the exterior and the interior of said container.

10. A pet litter box comprising:

a container having a floor section, a top substantially covering said floor section, and an opening providing an entrance to said container;

a ventilation subsystem having an air duct with an air exhaust vent positioned proximally to said opening to said container and an air intake positioned distally from said entrance and further including:

a) first and second electrode arrays positioned within said air duct so that said first electrode array is located between said air intake and said second electrode array and said second electrode array is positioned between said air exhaust vent and said first electrode array; and b) a voltage regulator electrically coupled to said first electrode array and said second electrode array to generate a voltage differential between said first electrode array and said second electrode array that creates air flow moving from said first electrode array to said second electrode array such that airborne particulate matter collects on said second electrode array;

an ultraviolet light source positioned in said air duct to irradiate said exhaust prior to its passing over said entrance to said container;

wherein said air flow generates exhaust expelled out of said exhaust vent to create an air curtain barrier at said entrance to said container.

* * * * *